United States Patent [19]

Cheon

[11] 4,199,631

[45] Apr. 22, 1980

[54] DESIGN AND METHOD OF FABRICATING SAME

[76] Inventor: Yong-Duek Cheon, 5539 21st South, Seattle, Wash. 98108

[21] Appl. No.: 743,178

[22] Filed: Nov. 19, 1976

[51] Int. Cl.[2] ..... B92B 3/14; B14C 1/00

[52] U.S. Cl. ..... 428/14; 156/63; 427/199; 427/203; 427/258; 427/282; 428/47; 428/49; 428/189; 428/195; 428/206

[58] Field of Search ..... 428/47, 49, 50, 167, 428/206, 195, 189, 38, 39, 67, 14; 427/199, 203, 258, 261, 265, 282, 272; 101/129, 114; 156/62.2, 248, 63; 35/26, 27

[56] References Cited

U.S. PATENT DOCUMENTS

| | | | |
|---|---|---|---|
| 227,377 | 5/1880 | Meyer | 428/67 |
| 1,611,950 | 12/1926 | Riddle | 428/14 |
| 1,813,901 | 7/1931 | Bayne | 156/63 |
| 2,190,627 | 2/1940 | Payberg | 428/138 |
| 2,876,575 | 3/1959 | Leika | 156/248 |
| 3,031,324 | 4/1962 | Jankowski | 101/129 |
| 3,414,426 | 12/1968 | Hughes et al. | 427/184 |
| 3,420,728 | 1/1969 | Haverstock | 428/38 |
| 3,770,535 | 11/1973 | Morrison | 428/195 |
| 3,900,641 | 8/1975 | Woodman et al. | 427/259 |

*Primary Examiner*—George F. Lesmes
*Assistant Examiner*—P. Thibodeau
*Attorney, Agent, or Firm*—Seed, Berry, Vernon & Baynham

[57] ABSTRACT

A design is fabricated by placing an outline of the design on a surface and covering the outline with fragments of material such as mother-of-pearl so that the fragments extend beyond the outer periphery of the outline. An opaque mask is placed on the fragments and the surface surrounding the fragments in registry with the outline to insure that the mask is properly aligned with the fragments. The mask conceals the fragments extending beyond the periphery of said outline as well as the surface to which the fragments are secured. The mask may include a pattern covering the fragments in the design for simulating a line between adjoining mother-of-pearl fragments which have been precisely cut to match each other as in a conventional mother-of-pearl design. Finally the fragments and the surrounding surface are covered with a clear sealant to protect the design.

4 Claims, 8 Drawing Figures

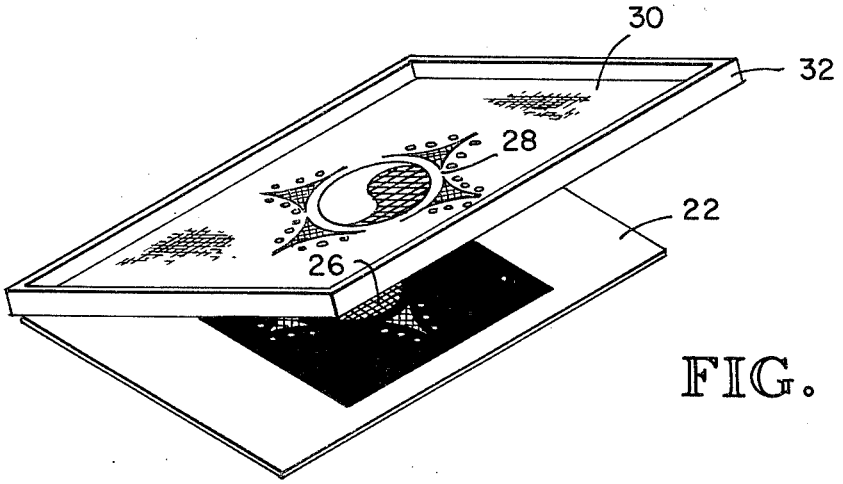
FIG. 5
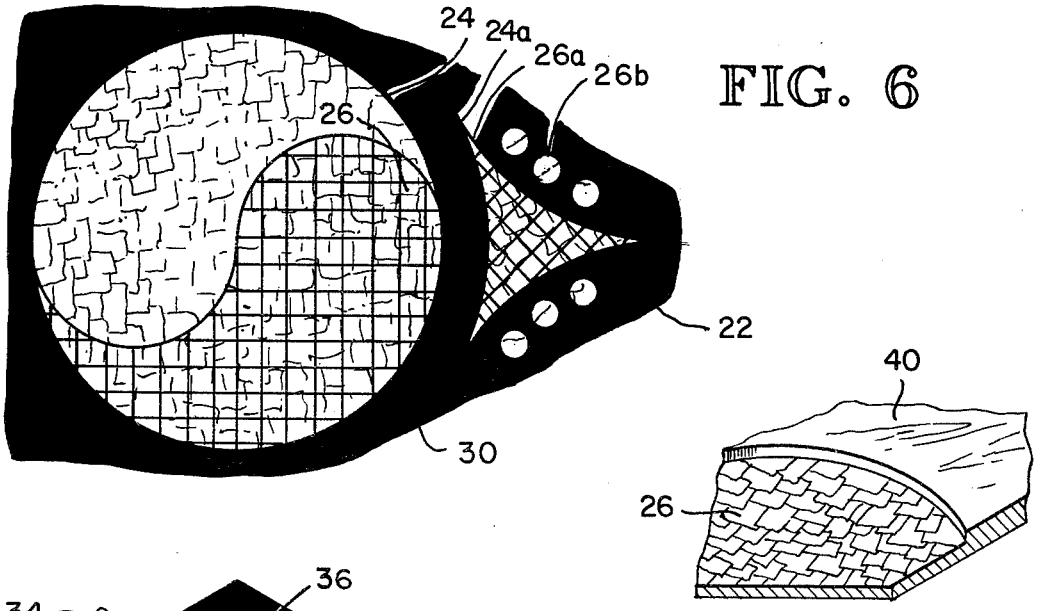
FIG. 6
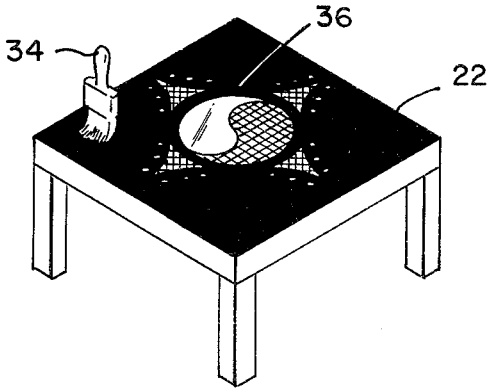
FIG. 8
FIG. 7

DESIGN AND METHOD OF FABRICATING SAME

BACKGROUND OF THE INVENTION

1. Field of the Invention

This invention relates to a fragment design and a method of fabricating same and, more particularly, to a motor-of-pearl design which does not require intricate cutting of mother-of-pearl fragments.

2. Description of the Prior Art

Mother-of-pearl designs have long been valued for their delicate beauty. These designs are conventionally created by cutting a plurality of mother-of-pearl fragments to a desired shape and securing the fragments to a surface. This technique is relatively simple to perform for fairly simple designs since intricate cutting is not required. However, complex designs require a great deal of skill to cut the mother-of-pearl fragments to form intricate shapes. Furthermore, many of the mother-of-pearl fragments are extremely thin and hence tend to tear during the cutting procedure. In fact, it is often impossible to create some mother-of-pearl designs since there is a practical limit to how finely detailed the fragments may be cut. Even for designs of a moderate complexity, skilled labor is required and the task is extremely lengthy and hence expensive. Thus the high cost of such mother-of-pearl designs have severely limited their availability, and the extreme complexity of the conventional fabricating technique has prevented certain complex designs from being implemented in a mother-of-pearl design.

SUMMARY OF THE INVENTION

It is an object of the invention to provide a design which does not require intricate cutting of fragments and thus can be produced by relatively unskilled labor.

It is another object to provide a design which may be far more complex than designs fabricated by conventional techniques.

It is still another object of the invention to provide a mother-of-pearl design which is relatively inexpensive to produce yet appears to be identical to mother-of-pearl designs produced by conventional techniques.

These and other objects of the invention are provided by securing a plurality of roughly cut fragments which may be mother-of-pearl to a surface with the fragments extending beyond the periphery of the design. If desired, an outline may be initially placed on the planar surface to guide in the placement of the fragments. After the fragments have been secured to the planar surface, an opaque mask is placed over the surface around the fragments and over the portion thereof extending beyond the periphery of the design to conceal the fragments and surface surrounding the design. The mask may include a pattern covering the fragments for simulating the line of intersection between adjacent fragments. Finally, the fragments and surface are covered with a clear sealant to protect the design. If desired, multicolored fragments may be used in accordance with a predetermined color scheme. Although the invention has been described herein as principally relating to mother-of-pearl designs, designs may also be fabricated from fragments of other materials.

BRIEF DESCRIPTION OF THE FIGURES OF THE DRAWING

FIG. 5 is an isometric view illustrating the next step of the method wherein an opaque mask is placed on the surface around the design and on the fragments projecting beyond the periphery of the design utilizing a silk-screen technique.

FIG. 6 is a top plan view showing the details of the completed design.

FIG. 7 is an isometric view illustrating the final step of the inventive method wherein a layer of clear material is being applied to the surface and the design.

FIG. 8 is an isometric view illustrating a design utilizing wood venier as an opaque mask surrounding the design.

DETAILED DESCRIPTION OF THE INVENTION

Figure 1:
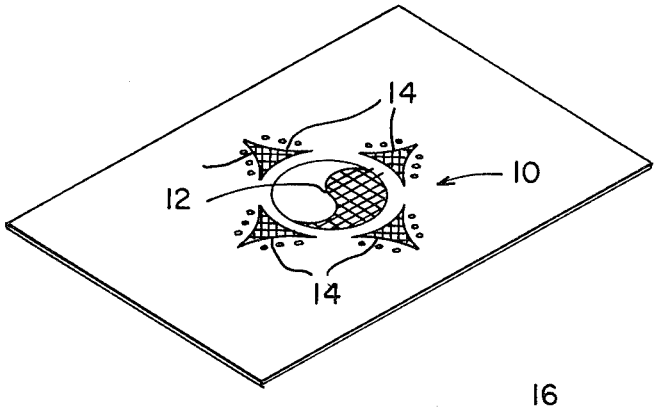
FIG. 1 is an isometric view of a design which is to be constructed of fragments in accordance with the inventive method.
Figure 2:
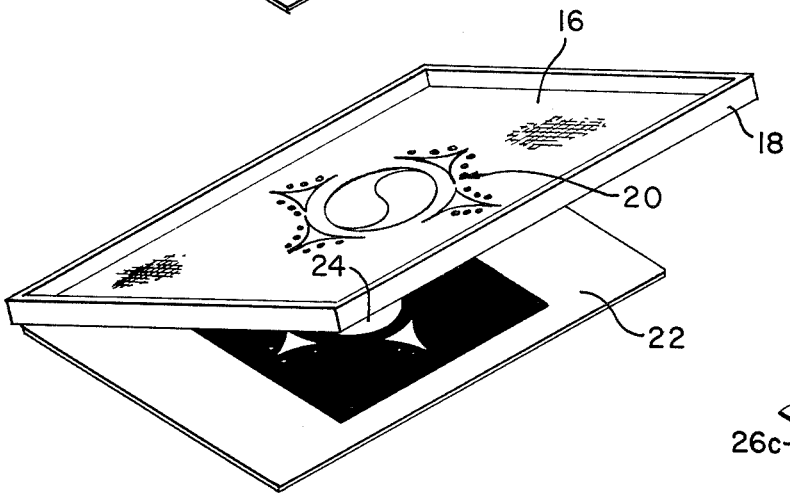
FIG. 2 is an isometric view of the first step of the inventive method wherein an outline of the design is placed on a surface using a silk-screen technique.

The design is to be constructed in accordance with a predetermined design such as is illustrated in FIG. 1. The design 10 includes a center portion 12 and four generally triangular designs 14 having a row of dots bordering their outer edges which are circumferentially spaced around the center design 12.

The outline of the design 10 is first placed on a silk-screen 16 which is mounted in a rectangular frame 18. The outline 20 on the silk-screen 16 is then applied to a surface 22 by conventional silk-screen techniques.

Figure 3:
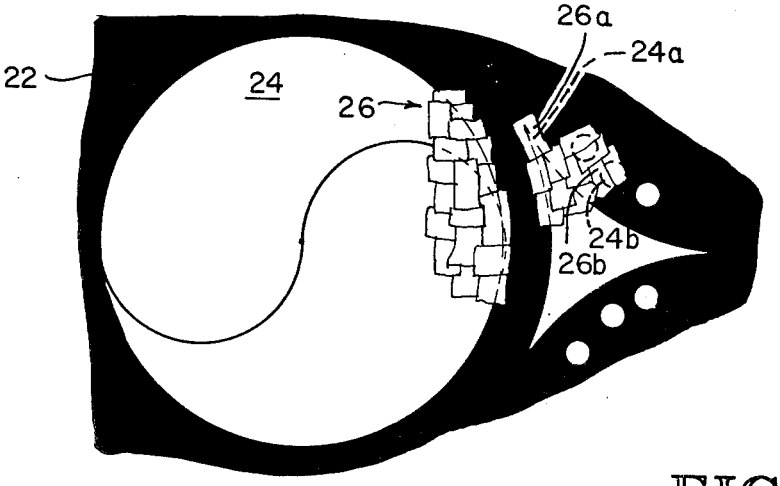
FIG. 3 is a top plan view illustrating the next step of the method wherein fragments of random size and shape are secured to the surface so that they completely cover the outline of the design.

With reference to FIG. 3, the outline 24 on the planar surface 22 is utilized as a guide for the placement of fragments, generally indicated by reference numeral 26. The fragments 26 are preferably mother-of-pearl but any appliable material such as wood, vinyl or glass may also be used. In accordance with the preferred embodiment, the fragments 26 are described herein as being mother-of-pearl fragments, but it will be understood that the inventive technique covers other fragments. The fragments 26 are secured to the surface 22 by gluing or some other suitable technique so that they completely cover the outline 24 and extend slightly beyond its periphery. Under some circumstances the fragments may be placed within a portable raised border guide or other guide means (not shown) so that it is not necessary to place an outline 24 of the design on the surface 22.

Figure 4:
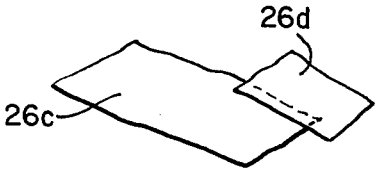
FIG. 4 is a detailed isometric view illustrating a pair of fragments secured to the surface.

It is important to note that it is not necessary that the shape of the mother-of-pearl fragments conform to the shape of the outline. For example, the narrow apex **24*a* found in a portion of the design is covered by a substantially larger fragment 26*a*. Similarly, the circular portions of the design 24*b* are covered with a generally rectangular mother-of-pearl fragment 26*b*. Thus it is not necessary to accurately cut the mother-of-pearl fragments in order to implement fairly intricate designs. A detailed view of a pair of mother-of-pearl fragments secured to the surface is illustrated in FIG. 4. The mother-of-pearl fragments 26***c,d* can overlap each other so that it is not necessary to cut adjacent mother-of-pearl fragments such that their edges conform to each other. Consequently, the mother-of-pearl design can be constructed relatively quickly by relatively unskilled workmen as opposed to conventional mother-of-pearl techniques which require a great deal of time and can only be implemented by extremely skilled artisans.

An opaque mask is then placed around the design as illustrated in FIG. 5. An outline of the design 28 is placed on a conventional silk screen 30 which is mounted in a rectangular frame 32. The silk screen 30 is adapted to cover all portions of the surface 22 and mother-of-pearl fragments 26 extending beyond the periphery of the design. When the mother-of-pearl fragments cover the entire surface, the mask will, of course, not be necessary. As illustrated in FIG. 6, the opaque mask completely obscures portions of the mother-of-pearl fragments 26 extending beyond the periphery of the outline 24 so that the design appears as if each of the fragments 26 were cut to conform to the shape of the design. For example, the rectangular mother-of-pearl fragments 26*b* placed over the circular outline 24*b* appear to be mother-of-pearl fragments cut into precise circles. Similarly, the fairly broad mother-of-pearl fragment 26*a* covering the apex of the triangular design 24*a* appears to be an intricately cut mother-of-pearl fragment. An opaque mask may also be formed by placing any opaque material around the design such as the layer of wood venier 40 illustrated in FIG. 8. Fairly thick materials such as the wood venier 40 thus simulate an inlaid mother-of-pearl design.

The mask 20 may also place a predetermined pattern on the mother-of-pearl fragments 26 within the design. As illustrated in FIGS. 5–7 the pattern placed on the mother-of-pearl fragments in the design are rectangular grids placed on the mother-of-pearl fragments in the circle and on the fragments in each of the triangular portions. The pattern simulates the line between abutting mother-of-pearl fragments cut to match each other by conventional techniques so that the design appears to consist of a large number of precisely cut mother-of-pearl fragments.

Finally, the mother-of-pearl design 36 and surface 22 are covered with a clear material which may be a lacquer applied with a brush 34 as illustrated in FIG. 7. The clear material covering the design 36 and surface 22 protects the mother-of-pearl fragments 26 from damage due to impacts, sharp objects, etc.

Although the inventive technique has been illustrated herein for applying a mother-of-pearl design to a table, it will be understood that such mother-of-pearl designs can be applied to virtually any surface. Further, as mentioned above, fragments of materials other than mother-of-pearl such as wood, glass, vinyl, etc., may also be used. The inventive technique thus allows such designs to be quickly fabricated at relatively low cost. The resulting mother-of-pearl design is virtually indistinguishable from substantially more expensive, conventionally produced mother-of-pearl designs.

The embodiments of the invention in which a particular property or privilege is claimed are defined as follows:

1. A method of fabricating a design occupying a predetermined design area on a surface, comprising:

securing a plurality of decorative fragments to said surface to cover said design area with some of said fragments extending beyond the periphery of said design area;

placing an opaque fluid on said surface and said fragments around the periphery of said design area so that the surface around said fragments and the portion of said fragments extending beyond said design area are masked by said fluid;

placing a predetermined pattern on said fragments within said design area, said pattern simulating the intersection of fragments cut to match each other such that said design appears to consist of a large number of fragments precisely cut in accordance with said pattern; and covering said fragments within said design area with a clear sealant to protect said fragments.

2. A design fabricated by the method of claim 1.

3. A method of fabricating a design occupying a predetermined design area on a surface comprising:

securing a plurality of decorative fragments to said surface to cover said design area with some of said fragments extending beyond the periphery of said design area;

placing an opaque pattern on said fragments, said pattern simulating the intersection of fragments cut to match each other such that said design appears to consist of a large number of such fragments precisely cut in accordance with said pattern; and masking the fragments extending beyond the design area with an opaque fluid; and covering said fragments within said design area with a clear sealant to protect said fragments.

4. A design occupying a predetermined design area on a surface, comprising:

a plurality of decorative fragments secured to said surface to cover said design area with some of said fragments extending beyond the periphery of said design area;

an opaque mask formed on said surface and said fragments around the periphery of said design area by applying thereto an opaque fluid so that the surface around said fragments and portions of said fragments extending beyond said design area are masked by said fluid, said mask further including a predetermined pattern covering at least a portion of said fragments within the periphery of said design area, said pattern simulating the intersection of fragments cut to match each other such that said design appears to consist of a large number of fragments precisely cut in accordance with said pattern; and a layer of clear sealant covering said fragments within said design area to protect said fragments.

* * * * *